US005344155A

United States Patent [19]

Huang

[11] Patent Number: 5,344,155

[45] Date of Patent: Sep. 6, 1994

[54] HOOK AND LOOP FASTENED PROJECTILE AND TARGET DEVICE

[76] Inventor: Jung-Feng Huang, Taichung, Taiwan

[21] Appl. No.: 218,812

[22] Filed: Mar. 28, 1994

[51] Int. Cl.[5] ..... A63B 67/00; F41J 7/00

[52] U.S. Cl. ..... 273/346; 273/58 A; 273/58 K; 273/407; 273/DIG. 30

[58] Field of Search ..... 273/346, DIG. 30, 58 R, 273/58 A, 58 K, 348, 407

[56] References Cited

U.S. PATENT DOCUMENTS 3,857,566 12/1974 Lemelson et al. ..... 273/346
3,927,881 12/1975 Lemelson et al. ..... 273/58 K
4,235,042 11/1980 Hills ..... 273/DIG. 30 X
4,415,154 11/1983 Engelhardt ..... 273/346 X
4,995,617 2/1991 Lee ..... 273/346
5,085,442 2/1992 Lee ..... 273/346

*Primary Examiner*—William H. Grieb

[57] ABSTRACT

A projectile and target device includes a spherical projectile having a plurality of hook-threaded sheet members arcuately coated on a spherical core of the spherical projectile to fully cover the surface area of the projectile, and a target having a loop-threaded fabric sheet secured to a supporting screen, whereby upon throwing of the spherical projectile to the target, the projectile will be attached on the target by fastening the hook-threaded sheet members on the spherical projectile with the loop-threaded fabric sheet of the target, without loosening or releasing of the hook-threaded sheet members from the spherical projectile.

3 Claims, 3 Drawing Sheets

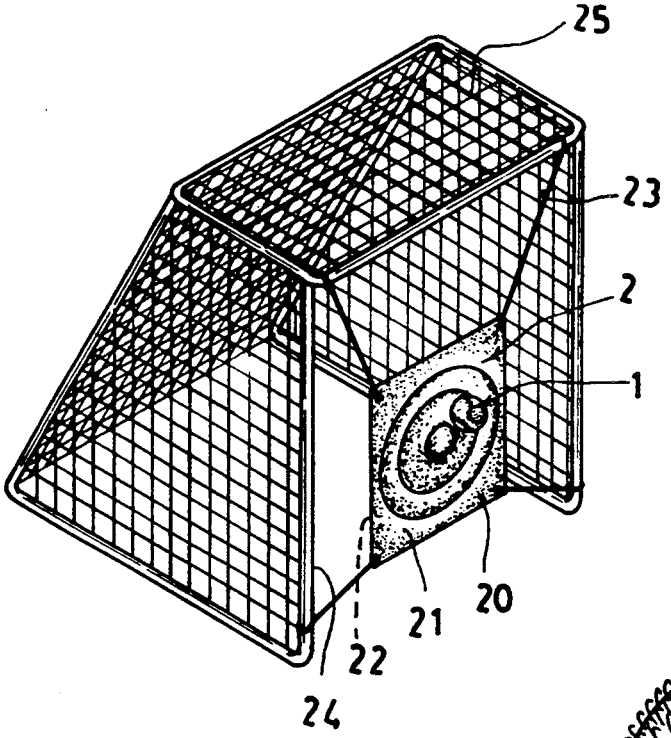
FIG.6
FIG.8
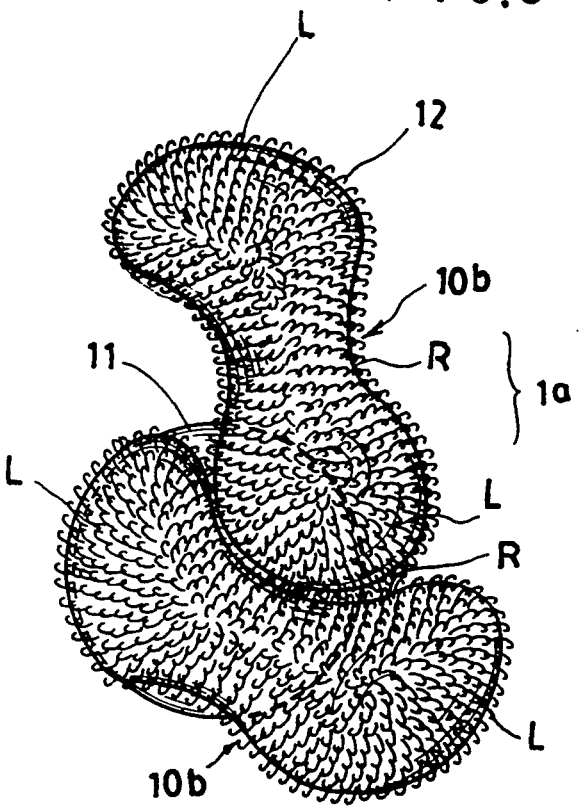
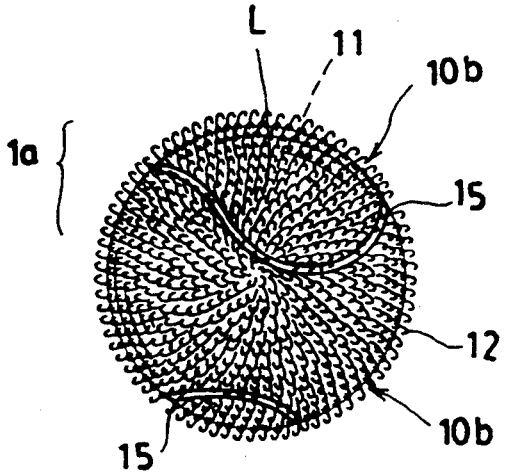
FIG.7
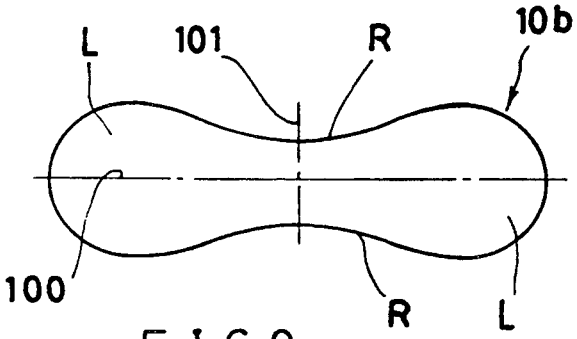
FIG.9

HOOK AND LOOP FASTENED PROJECTILE AND TARGET DEVICE

BACKGROUND OF THE INVENTION

A conventional projectile ball B as shown in FIG. 1 is wound thereon with two Velcro tapes V crossing with each other. The ball B will be thrown onto a target T having coarse surface formed on the target T to attach the ball on the target by fastening the Velcro tapes V on the ball B with the coarse surface on the target T.

However, the two Velcro tapes V wound on the ball B may be easily loosened and released from the ball B of spherical shape to lose its fastening effect, thereby being unable to be fastened to the coarse surface of the target T whenever throwing the ball to the target.

SUMMARY OF THE INVENTION

The object of the present invention is to provide a projectile and target device including a spherical projectile having a plurality of hook-threaded sheet members arcuately coated on a spherical core of the spherical projectile to fully cover the surface area of the projectile, and a target having a loop-threaded fabric sheet secured to a supporting screen, whereby upon throwing of the spherical projectile to the target, the projectile will be attached on the target by fastening the hook-threaded sheet members on the spherical projectile with the loop-threaded fabric sheet of the target, without loosening or releasing of the hook-threaded sheet members from the spherical projectile.

BRIEF DESCRIPTION OF THE DRAWINGS

FIG. 6 shows a projectile attached to a target means of the present invention.

FIG. 7 shows another preferred embodiment of the spherical projectile of the present invention.

FIG. 8 is an illustration showing the dressing of the spherical projectile as shown in FIG. 7.

FIG. 9 shows a dumbbell shaped hook-threaded sheet member when used in FIG. 7.

DETAILED DESCRIPTION

As shown in FIGS. 2–6, the present invention comprises: at least a spherical projectile 1, and a target means 2.

Figure 1:
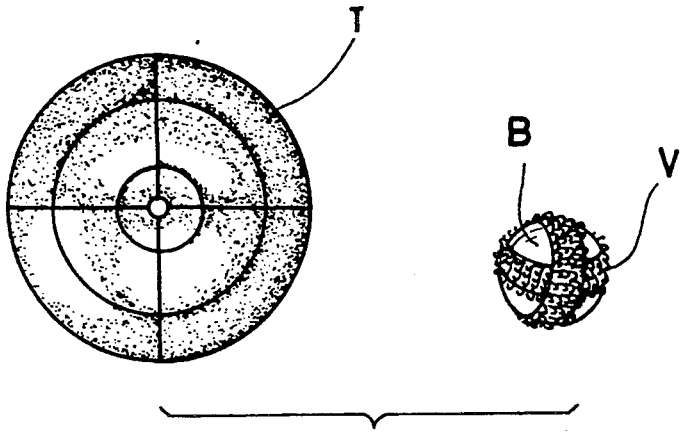
FIG.1 PRIOR ART
FIG. 1 shows a conventional projectile and target means.
Figure 2:
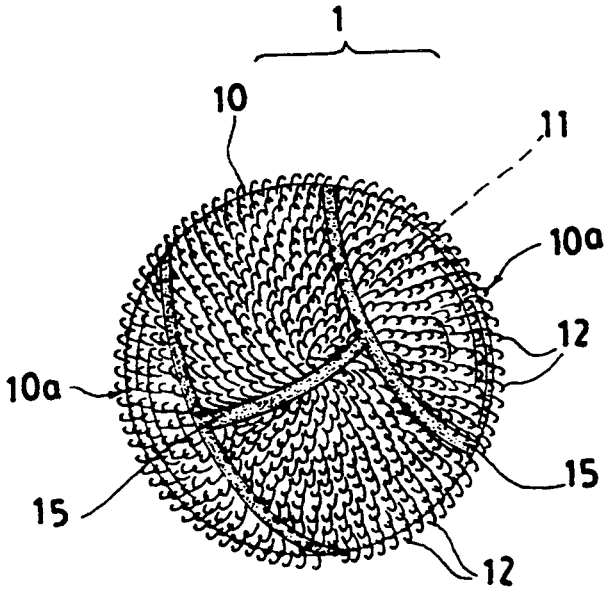
FIG. 2 is a perspective view of the present invention.

Each spherical projectile 1 includes: a spherical core 11 made of elastomer materials such as plastic or rubber materials; a plurality of hook-threaded sheet members 10, 10*a* circumferentially dressed or coated on the spherical core 11 by an elastic bonding adhesive 14 having suitable flexibility such as polyurethane type adhesive (but not limited in this invention); each hook-threaded sheet member 10, 10*a* including a hook-threaded surface portion 12 having a knitting base interlaced with a plurality of elastic rubber threads 13 with the elastic bonding adhesive 14 adhered on a back portion of the knitting base of each hook-threaded sheet member 10, 10*a* and on a circumferential surface of the spherical core 11, whereby upon curing and setting of the elastic bonding adhesive 14 in between each hook-threaded sheet member 10, 10*a* and the core 11, the hook-threaded sheet members 10, 10*a* will be firmly coated on the spherical core 11; and a sealant adhesive 15 filled in a plurality of apertures, each aperture existing at each junction portion between every two neighbouring hook-threaded sheet members 10, 10*a* or between two opposite end portions of one hook-threaded sheet member 10 as shown in FIG. 2, for sealing each said aperture.

The target means 2 as shown in FIG. 6 includes: a target blanket 20 secured to a supporting frame 24 by a plurality of fasteners 23, a screen 25 circumferentially disposed on the supporting frame 24, with the target blanket 20 having a loop-threaded surface portion 21 formed on a surface portion of a fabric sheet 22 of the target blanket 20.

When throwing the spherical projectile 1 onto the target means 2, the hook-threaded surface portion 12 on each hook-threaded sheet member 10, 10*a* will be fastened to the loop-threaded surface portion 21 on the target means 2 for attaching the projectile 1 on the target means 1.

The target means 2 may be marked with several target markings for aiming the projectile 1 thereto for interesting playing purpose. The projectile 1 may be made for simulating a golf, a tennis, a baseball or other games, not limited in this invention.

Since the hook-threaded sheet members 10, 10*a* are fully coated on the circumferential surface of the core 11 by elastic adhesive 14 and each sheet member 10, 10*a* is knitted with rubber threads 13, each sheet member 10, 10*a* will be resiliently stably secured on the spherical core 11 by a resilience F of the elastic rubber threads 13 and adhesive 14 to prevent easy loosening or releasing of the sheet members 10, 10*a* from the core 11.

Figure 3:
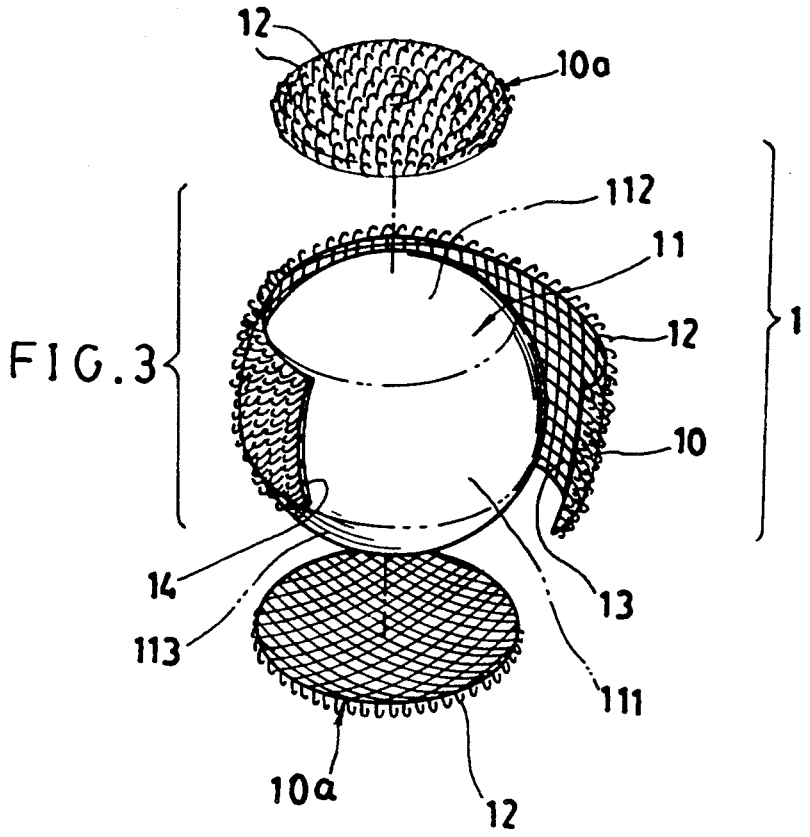
FIG. 3 is an exploded view showing the elements in construction of the present invention.
Figure 4:
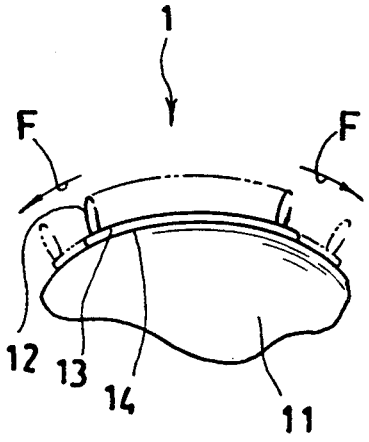
FIG. 4 is an illustration showing a resilient bonding of the hook-threaded sheet member on the spherical core of the present invention.
Figure 5:
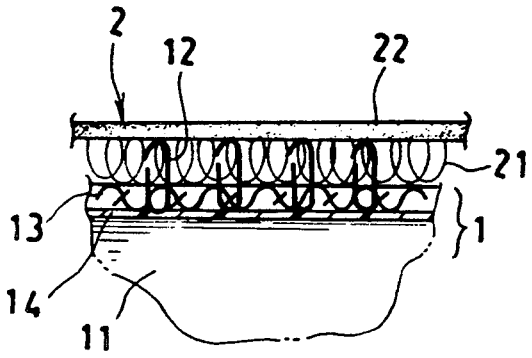
FIG. 5 is an illustration showing fastening of the hook-threaded sheet member of the projectile with the loop-threaded portion of the target means of the present invention.

The hook-threaded sheet members 10, 10*a* as shown in FIGS. 3, 2 includes: an elongate hook-threaded sheet member 10 arcuately coated on an intermediate spherical body portion 111 of the spherical core 11, and a pair of circular hook-threaded sheet members 10*a* respectively coated on a north-pole portion 112 and a south-pole portion 113 of the core 11 and disposed on two opposite sides of the elongate hook-threaded sheet member 10 coated on the intermediate spherical body portion 111, with the elongate and the two circular hook-threaded sheet members 10, 10*a* generally fully covering a spherical circumferential surface area of the spherical core 11 by the bonding adhesive 14.

Another preferred embodiment of the spherical projectile 1*a* is shown in FIGS. 7–9, which includes: a pair of dumbbell-shaped hook-threaded sheet members 10*b*, each dumbbell-shaped hook-threaded sheet member 10*b* having a pair of round lobe portions L disposed on two opposite side portions of each dumbbell-shaped hook-threaded sheet member 10*b* about a longitudinal axis 100 of the sheet member 10*b*, and a pair of arcuate recesses R each recess R concave inwardly towards the longitudinal axis 100 in between the two round lobe portions L about a latitudinal axis 101 perpendicular to the longitudinal axis 100, and one dumbbell-shaped hook-threaded sheet member 10*b* arcuately wound on the spherical core 10 to engage the other dumbbell-shaped hook-threaded sheet member 10*b* to fully cover a spherical circumferential surface of the core 11 with each lobe portion L of one dumbbell-shaped sheet member 10*b* engageable with each recess R of the other dumbbell-shaped sheet member 10*b*.

By the way, the sheet members 10, 10*a*, 10*b* can be fully covered on the core 11 and firmly bonded on the core 11 by the elastic adhesive 14, the hook-threaded sheet member 10, 10*a*, 10*b* will not be easily loosened or released from the core 11 for a reliable aiming, throwing, and playing actions of the projectile 1 when shot to the target means 2 in accordance with the present invention.

The present invention may be modified without departing from the spirit and scope of this invention.

I claim:

1. A projectile and target means comprising:

a target means 2; and at least one spherical projectile 1 operatively thrown onto said target means 2 to be fastened to said target means;

each said spherical projectile 1 including: a spherical core 11 made of elastomer materials; a plurality of hook-threaded sheet members 10, 10*a*, 10*b* circumferentially coated on the spherical core 11 by an elastic bonding adhesive 14; each said hook-threaded sheet member 10, 10*a*, 10*b* including a hook-threaded surface portion 12 having a knitting base interlaced with a plurality of elastic rubber threads 13 with the elastic bonding adhesive 14 adhered on a back portion of the knitting base of each said hook-threaded sheet member 10, 10*a*, 10*b* and on a circumferential surface of the spherical core 11, whereby upon curing and setting of the elastic bonding adhesive 14 in between each hook-threaded sheet member 10, 10*a*, 10*b* and the core 11, the hook-threaded sheet members 10, 10*a*, 10*b* will be firmly coated on the spherical core 11; and a sealant adhesive 15 filled in a plurality of apertures, each said aperture existing at each junction portion between every two neighbouring hook-threaded sheet members 10, 10*a*, 10*b* and between two opposite end portions of the hook-threaded sheet member 10 for sealing each said aperture; and said target means 2 including: a target blanket 20 secured to a supporting frame 24 by a plurality of fasteners 23, a screen 25 circumferentially disposed on the supporting frame 24, with the target blanket 20 having a loop-threaded surface portion 21 formed on a surface portion of a fabric sheet 22 of the target blanket 20, whereby upon throwing of the spherical projectile 1 onto the target means 2, the hook-threaded surface portion 12 on each hook-threaded sheet member 10, 10*a*, 10*b* will be fastened to the loop-threaded surface portion 21 on the target means 2 for attaching the projectile 1 on the target means 2.

2. A projectile and target means according to claim 1, wherein each said hook-threaded sheet member includes:

an elongate hook-threaded sheet member 10 arcuately coated on an intermediate spherical body portion 111 of the spherical core 11, and a pair of circular hook-threaded sheet members 10*a* respectively coated on a north-pole portion 112 and a south-pole portion 113 of the core 11 and disposed on two opposite sides of the elongate hook-threaded sheet member 10 coated on the intermediate spherical body portion 111, with the elongate and the two circular hook-threaded sheet members 10, 10*a* fully covering a spherical circumferential surface area of the spherical core 11 by the bonding adhesive 14.

3. A projectile and target means according to claim 1, wherein each said hook-threaded sheet member including:

a pair of dumbbell-shaped hook-threaded sheet members 10*b*, each said dumbbell-shaped hook-threaded sheet member 10*b* having a pair of round lobe portions L disposed on two opposite side portions of each said dumbbell-shaped hook-threaded sheet member 10*b* about a longitudinal axis 100 of the sheet member 10*b*, and a pair of arcuate recesses R each said recess R concave inwardly towards the longitudinal axis 100 in between the two round lobe portions L about a latitudinal axis 101 perpendicular to the longitudinal axis 100, and one said dumbbell-shaped hook-threaded sheet member 10*b* arcuately wound on the spherical core 10 to engage the other dumbbell-shaped hook-threaded sheet member 10*b* to fully cover a spherical circumferential surface of the core 11 with each said lobe portion L of one dumbbell-shaped sheet member 10*b* engageable with each said recess R of the other dumbbell-shaped sheet member 10*b*.

* * * * *